US010352515B1

(12) United States Patent
Yin

(10) Patent No.: US 10,352,515 B1
(45) Date of Patent: Jul. 16, 2019

(54) SIMULATED FLAME TIP AND SIMULATED CANDLE

(71) Applicant: Shunning Yin, Ningbo (CN)

(72) Inventor: Shunning Yin, Ningbo (CN)

( * ) Notice: Subject to any disclaimer, the term of this patent is extended or adjusted under 35 U.S.C. 154(b) by 0 days.

(21) Appl. No.: 15/871,148

(22) Filed: Jan. 15, 2018

(51) Int. Cl.

| | |
|---|---|
| ***F21S 10/04*** | (2006.01) |
| ***F21V 23/00*** | (2015.01) |
| ***F21V 3/02*** | (2006.01) |
| ***H05B 33/08*** | (2006.01) |
| *F21Y 115/10* | (2016.01) |

(52) U.S. Cl.
CPC ..... *F21S 10/043* (2013.01); *F21V 3/02* (2013.01); *F21V 23/006* (2013.01); *H05B 33/0845* (2013.01); *F21Y 2115/10* (2016.08)

(58) Field of Classification Search
CPC ..... F21S 10/046
See application file for complete search history.

(56) References Cited

U.S. PATENT DOCUMENTS

| | | | | |
|---|---|---|---|---|
| 9,897,270 | B2 * | 2/2018 | Wu | F21S 10/04 |
| 2018/0283634 | A1 * | 10/2018 | Ding | F21S 10/043 |
| 2018/0292058 | A1 * | 10/2018 | Li | F21S 10/046 |

* cited by examiner

*Primary Examiner* — Joseph L Williams
(74) *Attorney, Agent, or Firm* — Muncy, Geissler, Olds & Lowe, P.C.

(57) ABSTRACT

Disclosed is a simulated flame tip, comprising an LED lamp panel, a light transmission cover, a base, and a LED control module. The LED lamp panel comprises a plurality of arrayed LED lamp beads packaged on a surface of a circuit board in a COB manner, and the LED control module is configured to control the LED lamp beads to be gradually turned on/off in different array areas according to set timing. Further disclosed is a simulated candle that fits the simulated flame tip, which can achieve flame-like swaying and on/off changes after being powered on to emit light. The light is gentle, and is more realistic.

9 Claims, 3 Drawing Sheets

SIMULATED FLAME TIP AND SIMULATED CANDLE

FIELD OF THE INVENTION

The present utility model relates to the technical field of electronic candle lamps, and in particular, to a simulated flame tip and a simulated candle having the simulated flame tip mounted.

BACKGROUND OF THE INVENTION

Candles are widely used on stages and in daily life to heighten the atmosphere in scenes, and are indispensable in wedding and memorial ceremonies. However, the open fire of candles has a great potential safety hazard. Especially, in densely populated cities, life and property are subject to immeasurable loss once a conflagration occurs. With the improvement of people's fire safety awareness as well as the development of science and technology, electronic simulated candles are gradually accepted.

For the majority of current electronic simulated candles, an LED lamp is used as a light source, and the appearance of a candle is imitated. The LED lamp is placed on the top, and a bulb is covered under a flame-shaped lamp cap, to achieve a simulation effect. However, such a candle only has a similar appearance, and light produced by the bulb is totally different from real candlelight. Therefore, a simulated candle with a swinging lamp cap is designed on the market, and the lamp cap is swung to produce a seemingly flickering flame for people. However, although such a simulated candle imitates flickers of a flame to a certain extent, a flame of the simulated candle still appears to be fake due to its mechanical motion, and the simulated candle cannot produce a flame that appears as natural as a real flame, and fails to satisfy people's growing quality requirement. In addition, during mechanical swinging, a swinging blade easily gets stuck, leading to intermittent swinging, and the swinging blade even gets broken. As a result, the use effect is usually unsatisfactory.

Therefore, persons skilled in the art are dedicated to developing a simulated flame tip and a simulated candle, which can achieve flame-like swaying and on-off changes after being powered on, and light transmitted through the simulated flame tip is even and gentle, and is more realistic.

SUMMARY OF THE INVENTION

In view of the disadvantage in the prior art, the technical problem to be resolved in the present utility model is to develop a novel simulated flame tip and simulated candle, which can achieve flame-like swaying and on/off changes after being powered on to emit light. The light is gentle, and is more realistic.

To achieve the objective, the present utility model provides a simulated flame tip. An LED lamp panel and a light transmission cover are both connected to a base. The light transmission cover is flat, and comprises two light transmission surfaces that are symmetric in the front and back. A front light transmission surface and a back light transmission surface form a closed cavity, the LED lamp panel is sealed in the cavity, and an external contour line of each of the light transmission surfaces has a shape of being pointed at the top and expanding in the middle. The LED lamp panel comprises a plurality of arrayed LED lamp beads packaged on a surface of a circuit board in a COB manner, and an LED control module is configured to control the LED lamp beads to be gradually turned on/off in different array areas according to set timing. A manner for the LED control module to control the LED lamp beads on the LED lamp panel to be turned on/off comprises, but is not limited to: being sequentially turned on/off from one end to the other end of the LED lamp panel, being sequentially turned on/off from one end to a central portion and then to the other end of the LED lamp panel, and being sequentially turned on/off from one end to a bottom portion and then to the other end of the LED lamp panel.

Further, the LED control module comprises a single-chip IC circuit board and a single-chip IC write program module, and the LED lamp beads are electrically connected to the LED control module to form a closed loop.

Further, the manner for the LED control module to control the LED lamp beads on the LED lamp panel to be turned on/off comprises: being sequentially turned on/off from one end to the other end of the LED lamp panel, and being sequentially turned on/off from one end to the bottom portion and then to the other end of the LED lamp panel.

Further, the LED lamp panel has a similar shape as the light transmission surfaces.

Further, the LED lamp beads are mounted on two surfaces of the circuit board.

Further, the center of the light transmission surfaces is horizontally opposite to locations of the LED lamp beads.

Further, the light transmission cover is fixedly bonded to or inserted in the base.

A simulated flame tip according to the design has use effects as follows:

(1) As a COB light source is used, light is gentle, there is no dazzle, and costs are low.

(2) When LED lamp beads are powered on and emit light, light transmission surfaces have an effect of making the light gentle, and a light transmission cover refracts the light from inside to outside. As refractivity varies as the thickness of the light transmission surface changes, a light scattering range is large.

(3) An LED control module controls the LED lamp beads on a LED lamp panel to be successively turned on/off, and an on/off sequence is used to imitate flickers of a flame, so that it looks more realistic from outside.

(4) The LED lamp beads and the light transmission surfaces are symmetrically distributed in the front and back, which achieves a strong three-dimensional effect.

In an aspect of applying the novel simulated flame tip, the present utility model provides a simulated candle, comprising the simulated flame tip, a housing, and a power supply, wherein the power supply is disposed at a bottom portion of the housing, and a control switch is further disposed at the bottom portion of the housing.

Further, the LED lamp beads are electrically connected to the LED control module, the power supply, and the control switch through wires to form a lighting loop, and the power supply is a battery.

Further, the housing is made of paraffin wax, vegetable wax, plastic, or resin, and an upper end of the housing is processed into a concave shape like that formed after a candle melts.

The simulated candle in the present utility model has use effects as follows: A main body is made of paraffin wax or a material similar to paraffin wax, which does not feel distinctly different from a common candle. With the simulated flame tip and the main body combined, the product appears to be a simulated candle with a high degree of simulation.

The following further describes the concept, specific structures, and produced technical effects of the present utility model with reference to the accompanying drawings, to fully understand the purpose, features, and effects of the present utility model.

In the figures: 1 represents a simulated flame tip, 2 represents a housing, 3 represents a battery holder, 4 represents a cylindrical cavity, 11 represents a light transmission surface, 12 represents a base, and 13 represents an LED lamp panel.

DETAILED DESCRIPTION OF THE INVENTION

Figure 1:
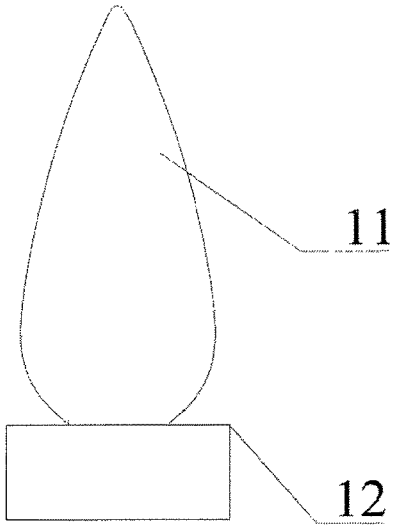
FIG. 1 is a schematic structural diagram of a simulated flame tip according to the present utility model, a sight line in FIG. 1 being perpendicular to a light transmission surface.
Figure 4:
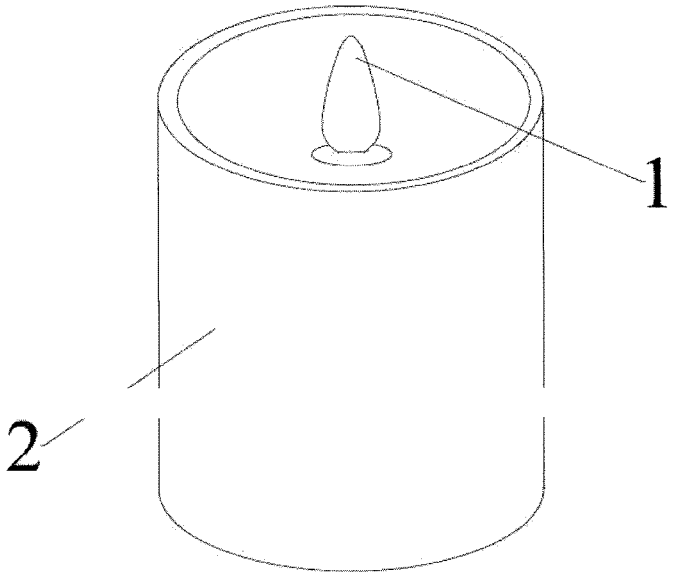
FIG. 4 is a schematic appearance diagram of another embodiment of a simulated candle according to the present utility model.

FIG. 1 is a schematic structural diagram of a simulated flame tip disclosed in the present utility model. Two light transmission surfaces 11 symmetrically distributed in the front and back on an upper portion of a simulated flame tip 1 form a light transmission cover, and the light transmission cover is flat, and is fixedly connected to a base 12. An LED control module is mounted in the base 12, or is directly arranged on an LED lamp panel. The LED lamp panel 13 has a similar shape as the light transmission surfaces, and has a shape of being pointed at the top and expanding in the middle like a sunflower seed shell. The two light transmission surfaces 11 form a closed cavity, and the LED lamp panel is sealed in the cavity. A sight line in FIG. 1 is in a direction perpendicular to a light transmission surface 11. Front and back light transmission surfaces 11 overlap in the direction. The LED lamp panel is located between the front and back light transmission surfaces 11. The LED lamp panel 13 is provided with a plurality of arrayed LED lamp beads packaged on a surface of a circuit board in a manner of COB packaging. As the LED lamp beads are packaged on the circuit board by using a COB technology, when the LED lamp beads 15 are placed on two surfaces of the board (as shown in FIG. 4), respective locations directly face the center of the light transmission surfaces 11. The LED control module comprises a single-chip IC circuit board and a single-chip IC write program module, and the LED lamp beads are electrically connected to the LED control module to form a closed loop. A manner for the LED control module to control the LED lamp beads on the LED lamp panel to be turned on/off comprises, but is not limited to: being sequentially turned on/off from one end to the other end of the LED lamp panel, and being sequentially turned on/off from one end to a bottom portion and then to the other end of the LED lamp panel. The light transmission surfaces 11 and the base 12 are made of a polymer material by means of injection molding. The light transmission surfaces 11 and the base 12 may be connected through an adhesive. Alternatively, a slot may be formed on the base 12, the two light transmission surfaces 11 are first bonded into a light transmission cover, and then the light transmission cover is inserted to the base 12. Edges of the two light transmission surfaces 11 are connected, and are generally curved, so that the light transmission surfaces 11 have thicknesses and refractivity changing at different locations, and gentle light transition from inside to outside of the light transmission surfaces 11 is achieved.

Figure 2:
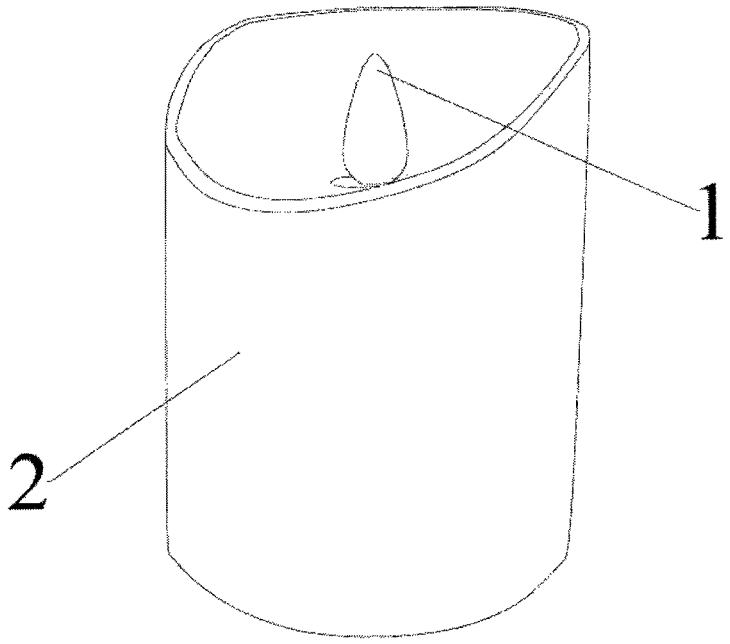
FIG. 2 is a schematic appearance diagram of a simulated candle according to the present utility model.

FIG. 2 is a schematic appearance diagram of an embodiment of a simulated candle using the simulated flame tip according to the present utility model. A housing 2 of the simulated candle is made of paraffin wax, vegetable wax, plastic, or resin, and an upper end of the housing 2 is processed into a concave shape like that formed after a candle melts. To enable the simulated candle to look realistic, a simulated candle wick is designed below the flame tip.

Figure 3:
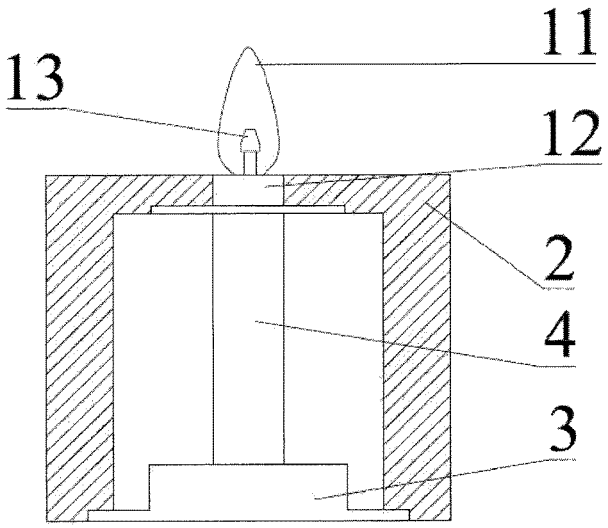
FIG. 3 is a schematic structural diagram of a simulated candle according to the present utility model.

FIG. 3 is a schematic structural diagram of a vertical section of the embodiment of the simulated candle in FIG. 2. The simulated candle mainly comprises a simulated flame tip 1, a housing 2, and a power supply. The power supply is a battery in a battery holder 3. The battery holder 3 is disposed at a bottom portion of the housing 2, and a control switch is further disposed at the bottom portion of the housing 2. The LED lamp panel is electrically connected to the LED control module, the power supply, and the control switch through a wire of the base 12 and a cylindrical cavity 4, to form a lighting loop. The cylindrical cavity 4 may be hollow, or may be solid, provided that a channel for connecting the LED lamp panel to a circuit is reserved in the solid body, which is not specifically limited in the present utility model.

During use, the LED control module controls the LED lamp beads to be powered on and emit light, and the LED lamp beads are gradually turned on/off in different array areas according to set timing. The LED lamp beads achieve a gentle light transmission effect on the light transmission surfaces 11 where light is the brightest in the center and gradually darkens to the outside, and a lighting range expands as much as possible. The front and back light transmission surfaces 11 on the light transmission cover are designed into a flame shape, and the center has the highest refractivity and brightest light, thereby achieving an effect of looking from outside like that there is a flame core in the center burning and emitting light.

To achieve a more realistic simulation effect, in the present utility model, the LED lamp panel 15 and the two light transmission surfaces 11 are particularly symmetrically distributed in the front and back on the base 12, the light transmission surfaces 11 have a similar shape as a sunflower seed, the cavity formed by the two light transmission surfaces 11 is transparent, and joint surfaces are as thin as possible. In this way, there is no opaque position, and a complete light-emitting flame can be seen after the present utility model is powered on. In addition, desired layering effects from different angles are achieved, and candlelight looks more realistic.

According to the appearance of the simulated candle, the LED lamp panel 13 may be disposed as a one-sided LED or a two-sided LED. As shown in FIG. 2, when a cylinder of the simulated candle has a back side higher than a front side, light emitted from the simulated flame tip to the back side is blocked, and the LED lamp panel may be disposed as a one-sided LED, and emit light only to the front side. As shown in FIG. 4, when an upper portion of a cylinder of the simulated candle is a plane, light from the simulated flame tip is not blocked, and the LED lamp panel may be disposed as a two-sided LED.

Figure 5:
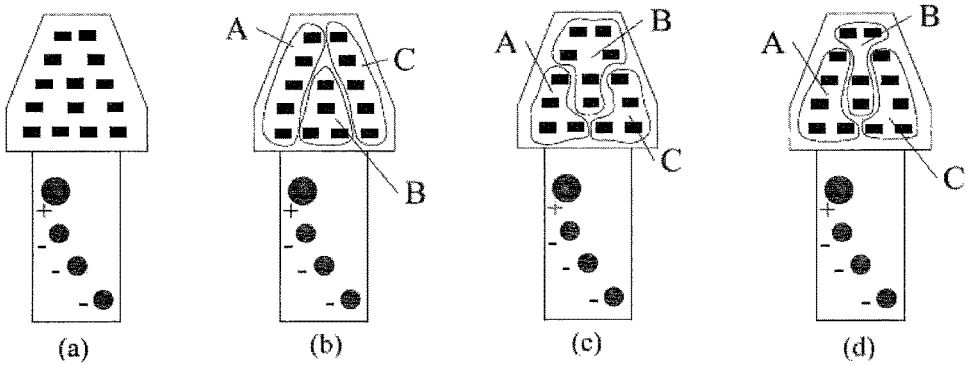
FIG. 5 is schematic diagrams of an LED lamp panel of a simulated candle according to the present utility model, where A, B, and C are light-emitting areas set in different embodiments.

A schematic diagram of the LED lamp panel 13 is shown in FIG. 5. In FIG. 5(*a*), 14 light spots formed by LED lamp beads are disposed on the LED lamp panel 13. The LED lamp beads are packaged on the lamp panel by using a COB technology. Positive and negative electrodes are disposed below the lamp panel. Three negative electrodes are respectively electrically connected to three power areas on the LED. The control module controls circuits between the positive and negative electrodes to be selectively turned on, to control different areas to be turned on/off.

The following briefly illustrates different effects achieved in embodiments where LED lamp beads on the LED lamp panel 13 emit light according to three areas A, B, and C shown in FIG. 5.

Embodiment 1

In Embodiment 1, the LED lamp beads are divided into three areas A, B, and C as shown in FIG. 5(*b*), and the LED control module controls the LED lamp beads to be turned on/off in a sequence as follows: A turn-on area first transits from the A area gradually to the B area, then transits from the B area gradually to the C area, and then transits from the C area back to the A area. The transition occurs at an interval of two seconds. Next, the turn-on speed becomes faster, and the transition occurs at an interval of one second. 25 such cycles are repeated. Next, the step is repeated. As seen from outside, it looks like the flame of the simulated candle sways around the center.

Embodiment 2

In Embodiment 2, the LED lamp beads are divided into three areas A, B, and C as shown in FIG. 5(*c*), and the LED control module controls the LED lamp beads to be turned on/off in a specific sequence as follows: A turn-on area of the LED lamp beads on the LED lamp panel first transits from the A area gradually to the B area, then transits from the B area gradually to the C area, and then transits in an opposite direction so that C, B, and A are sequentially turned on. One cycle takes one second, and 50 cycles repeated. Next, the step is repeated. As seen from outside, it looks like an upper portion of the flame of the simulated candle is being blown by wind.

Embodiment 3

In Embodiment 3, the LED lamp beads are divided into three areas A, B, and C as shown in FIG. 5(*d*), and the LED control module controls the LED lamp beads to be turned on/off in a specific sequence as follows: For turn-on areas of the LED lamp beads on the LED lamp panel, the A area and the C area are alternately turned on/off and the B area stays on, and the A area and the C area are alternately kept on for a time of 0.5 T. T is used as one cycle, and 25 cycles are repeated. Next, the step is repeated. As seen from outside, it looks like the flame of the simulated candle swings.

Embodiment 4

In Embodiment 4, the LED lamp beads are divided into three areas A, B, and C as shown in FIG. 5(*b*), and the LED control module controls the LED lamp beads to be turned on/off in a cycle of 2 T.

In a time from 0 to T: The A area turns dark, bright, and then dark. The B area turns bright, dark, and then bright. The A and B areas have an action time of T/3. The C area stays dark.

In a time from T to 2 T: The A area stays dark. The B area turns bright, dark, and then bright. The C area turns dark, bright, and then dark. The B and C areas have an action time of T/3.

25 cycles of 0 to 2 T are repeated, and the step is then repeated.

It should be understood that, by means of the LED control module, lamp beads in any area on the LED lamp panel can be set to be turned on/off according to different timing as required, thereby achieving different flame swaying effects, and used manners are not limited to those in the foregoing embodiments.

In the simulated candle in the present utility model, a main body is made of paraffin wax or a material similar to paraffin wax, which does not feel distinctly different from a common candle. With the simulated flame tip and the main body combined, the product appears to be a simulated candle with a high degree of simulation.

The preferred specific embodiments of the present utility model have been described in detail above. It should be understood that persons skilled in the art can make many modifications and changes according to the concept of the present utility model without creative efforts. Therefore, technical solutions obtained by persons skilled in the art in accordance with the concept of the present utility model on the basis of the prior art by logical analysis, reasoning, or limited experimentation should fall within the protection scope as defined by the claims.

The invention claimed is:

1. A simulated flame tip, comprising an LED lamp panel, a light transmission cover, a base, and an LED control module, wherein the LED lamp panel and the light transmission cover are both connected to the base; the light transmission cover is flat, and comprises two light transmission surfaces that are symmetric in the front and back, a front light transmission surface and a back light transmission surface form a closed cavity, the LED lamp panel is sealed in the cavity, and an external contour line of each of the light transmission surfaces has a shape of being pointed at the top and expanding in the middle; and the LED lamp panel comprises a plurality of arrayed LED lamp beads packaged on a surface of a circuit board in a COB manner, and the LED control module is configured to control the LED lamp beads to be gradually turned on/off in different array areas according to set timing; and a manner for the LED control module to control the LED lamp beads on the LED lamp panel to be turned on/off comprises, but is not limited to: being sequentially turned on/off from one end to the other end of the LED lamp panel, being sequentially turned on/off from one end to a central portion and then to the other end of the LED lamp panel, and being sequentially turned on/off from one end to a bottom portion and then to the other end of the LED lamp panel.

2. The simulated flame tip according to claim 1, wherein the LED control module comprises a single-chip IC circuit board and a single-chip IC write program module, and the LED lamp beads are electrically connected to the LED control module to form a closed loop.

3. The simulated flame tip according to claim 1, wherein the LED lamp panel has a similar shape as the light transmission surfaces.

4. The simulated flame tip according to claim 1, wherein the LED lamp beads are mounted on two surfaces of the circuit board.

5. The simulated flame tip according to claim 1, wherein the center of the light transmission surfaces is horizontally opposite to locations of the LED lamp beads.

6. The simulated flame tip according to claim 1, wherein the light transmission cover is fixedly bonded to or inserted in the base.

7. A simulated candle, comprising the simulated flame tip according to claim 1, a housing, and a power supply, wherein the simulated flame tip is fixedly connected to an upper surface of the housing, and the power supply is mounted at a bottom portion of the housing.

8. The simulated candle according to claim 7, wherein the power supply is disposed at the bottom portion of the housing, a control switch is further disposed at the bottom portion of the housing, the LED lamp beads are electrically connected to the LED control module, the power supply, and the control switch through wires to form a lighting loop, and the power supply is a battery.

9. The simulated candle according to claim 7, wherein the housing is made of paraffin wax, vegetable wax, plastic, or resin, and an upper end of the housing is processed into a concave shape like that formed after a candle melts.

* * * * *